US006006051A

United States Patent [19]

Tomita et al.

[11] Patent Number: 6,006,051

[45] Date of Patent: Dec. 21, 1999

[54] ELECTROPHOTOGRAPHIC APPARATUS AND IMAGE FORMING APPARATUS EMPLOYED THEREIN WITH CONTROLLED TIMING OF A POWER SUPPLY

[75] Inventors: Kan Tomita, Tokyo; Masaharu Furuya, Yokohama, both of Japan

[73] Assignee: Ricoh Company, Ltd., Tokyo, Japan

[21] Appl. No.: 08/734,075

[22] Filed: Oct. 21, 1996

[30] Foreign Application Priority Data

Oct. 19, 1995 [JP] Japan ..... 7-271054
Nov. 24, 1995 [JP] Japan ..... 7-305876

[51] Int. Cl.[6] ..... G03G 15/20

[52] U.S. Cl. ..... 399/69; 219/216; 399/70

[58] Field of Search ..... 399/67, 69, 70, 399/328, 330, 320; 219/216, 469, 470; 432/60

[56] References Cited

U.S. PATENT DOCUMENTS 5,191,381 3/1993 Yuan ..... 219/216 X
5,229,577 7/1993 Matsuura et al. ..... 219/216 X
5,656,187 8/1997 Miyamoto et al. ..... 219/216

*Primary Examiner*—William Royer
*Attorney, Agent, or Firm*—Oblon, Spivak, McClelland, Maier & Neustadt, P.C.

[57] ABSTRACT

An electrophotographic apparatus employing a self-heat-emitting heating roller capable of causing current to flow through a heat emitting resistor at a time of turning on a power supply until a maximum electric power to be consumed in the electrophotographic apparatus, to thereby shorten a rising-up time of the heating-roller fixing apparatus. The drive starting temperature is previously set and the heat emitting resistor is selected so as to satisfy the following inequalities:

$$V^2/R_3 \leqq /V^2/R_2 < W_{max} - W_m \leqq W_1 < V^2/R_0 \leqq W_{max} - W_s.$$

An image forming apparatus included in the above-mentioned electrophotographic apparatus prevents an excessive current flowing through the fixing apparatus in a case of turning on the power supply on a condition that the temperature in the apparatus does not rise up sufficiently, and thereby the apparatus is not damaged. Such an apparatus can be provided at a low cost.

30 Claims, 6 Drawing Sheets

ELECTROPHOTOGRAPHIC APPARATUS AND IMAGE FORMING APPARATUS EMPLOYED THEREIN WITH CONTROLLED TIMING OF A POWER SUPPLY

FIELD OF THE INVENTION

The present invention relates to an eletrophotographic apparatus provided with a thermal-roller fixing apparatus, and in particular, to an image forming apparatus in a copying machine, a printer, a facsimile device, etc., employing an electrophotographic process.

DESCRIPTION OF THE RELATED ART

In recent years, and with reference to FIG. 1, a thermal-roller fixing apparatus 1 of an electrophotographic apparatus is constructed similar to that of the embodiment of the present invention. So, the background thermal-roller fixing apparatus 1 is described hereinafter referring to FIG. 1.

A heat emitting resistor is disposed in the main body of a heating roller 2. The thermal-roller fixing apparatus 1 includes the heating roller 2 of a self-heat-emitting type having electrode portions 4 and 4' of the heat emitting resistor, a pressurizing roller 3 brought into pressurized contact with the heating roller 2 and rotated together with the heating roller 2, a thermistor 6 for detecting a temperature of the heating roller 2, and power supply portions 5 and 5' for supplying electric power to the heat emitting resistor by electrode portions 4, 4'. Each of these elements are accommodated in a housing (not shown). The fixing apparatus 1 further includes a system control portion 7 receiving an output of the thermistor 6 and outputting an electric supply commanding signal to an AC control portion 8 for supplying electricity to the heat emitting resistor.

In such a fixing apparatus as described above, the power supply to the electrode portions 4 and 4' is executed such that the system control portion 7 receives the output of the thermistor 6 and calculates the temperature, and the system control portion 7 outputs an ON/OFF signal to the AC control portion in order to control the electric supply to the heat emitting resistor. Such temperature control can be executed by performing an ON-OFF control operation in accordance with whether a value of the detected temperature is higher or lower than a previously set temperature value. Alternately, temperature control can be executed also by performing a phase control operation of changing a duty cycle of the ON/OFF in accordance with the difference between the detected temperature and the previously set temperature value. In addition, the system control portion 7 performs a sequence control of the entire electrophotographic apparatus such as a timing control, etc. of turning on and off an actuating system of motor 10, solenoid 11, clutch 12, and so on.

A silver-palladium alloy, e.g., is used as the heat emitting resistor of such a thermal-roller fixing apparatus 1. In such a fixing apparatus, the characteristic of the heat emitting resistor is as shown in FIG. 5. Namely, at a time of driving the fixing operation, the heat emitting resistor (B) is selectively employed as one having a resistance value for which a current flows through the heat emitting resistor (B) such that a maximum electric power ($W_{max}-W_s$) capable of consuming at maximum at the time of driving is obtained by subtracting the power consumption ($W_s$) of the control system circuit boards of the system control portion 7, the AC control portion 8, and power supply circuit 9, etc. and the power consumption $W_m$ of the motor 10, the clutch 12, the solenoid 11, and the exposing lamp, etc. from the maximum rated power value of the electrophotographic apparatus.

Such a heat emitting resistor (B) is one of a resistance value not equal to the value for which a current flows through the heat emitting resistor (B) until a maximum power ($W_{max}-W_s$) capable of consuming at the time of not driving obtained by subtracting the power consumption ($W_s$) of the control system circuit boards from the maximum rating power ($W_{max}$) of the electrophotographic apparatus immediately after being powered on. Namely, the resistance value of the heat emitting resistor has a small positive temperature coefficient so as not to largely lower the resistance value even at the maximum power ($W_{max}-W_s$) capable of consuming at the time of not driving.

The resistance value of the heat emitting resistor (B) immediately after being powered on is not the low value so as to flow the current until a maximum power ($W_{max}-W_s$) capable of consuming at the time of not driving. Therefore, the amount of emitted heat is small and thereby it takes much time to rise up to the state of "copying-ready". This is a drawback in the background art.

As a countermeasure of solving such a problem, both of a piece of a main heat emitting resistor and a piece of a sub-heat-emitting resistor may be employed in parallel after being powered on in order to shorten the rising-up time of the heating roller 2. In such a state, the temperature of the heating roller 2 becomes the temperature of "copying-ready". After the previously set time period elapses, the power supplied to the sub-heat emitting resistor is turned off.

In recent years, energy saving has been required in an image forming apparatus such as a copying machine, printer, facsimile device, etc. employing an electrophotographic system. It has been already proposed to employ a fixing apparatus by use of a self-heat-emitting type heating roller as one countermeasure to be taken.

In a background heating roller, a halogen heater is disposed in an interior of a hollow pipe-state roller and an entire portion of the roller is heated by the heat emission of the halogen heater. However, the heating roller in such a system does not have a high heating efficiency and it is disadvantageous in energy saving.

On the other hand, the self-heat-emitting type heating roller in which an electric resistor is mounted on an outer surface of the roller and heat is emitted therefrom by supplying electricity to the resistor emits heat from the roller surface layer, has high efficiency of heating, and is suitable for saving energy. A fixing apparatus employing a heating roller of this system has high efficiency of heating compared with the background fixing apparatus containing the halogen heater, and the same can expect a high-speed rising-up time. This is a merit of the self-heating type heating roller.

In order to sufficiently utilize this merit, it is necessary to supply electricity to the heater (resistor) only at the time of causing the paper to be fixed to pass therethrough and to cut off pre-heating at other times. However, in order to momently raise up the (fixing) apparatus immediately after the user starts to use the apparatus, it is required to make the rising-up time of the self-heat-emitting type heating roller extremely short.

In a fixing apparatus employing a self-heat-emitting type heating roller, the rising-up time is short compared with the background fixing apparatus employing the halogen heater. However, the rising-up time thereof is not sufficiently short and thereby it is desired to be further improved.

In addition, it has not yet been realized to put on the market an electrophotographic apparatus employing such a self-heating type heating roller, and the countermeasure for raising up the heating efficiency of the heating roller itself to further shorten the rising-up time is being studied now. However, the control method of effectively utilizing the property of the self-heat-emitting type heating roller has not yet been reported. If we consider the above fixing apparatus in the same way as the case of employing the background halogen heater type fixing apparatus, it may be possible to bring to the utmost the consumed electric power immediately after turning on the power supply (the electric power to be supplied to the self-heat-emitting type heating roller immediately after turning on the power supply) close to the maximum power capable of being supplied to the fixing apparatus.

SUMMARY OF THE INVENTION

Accordingly, one object of the present invention is to overcome the above-mentioned drawbacks in the background art.

As mentioned heretofore, in the background thermal-roller fixing apparatus, since electric power is supplied to a main heat emitting resistor and a sub-heat-emitting resistor at a same time after turning on the power supply, and the power supplied to the sub-heat-emitting resistor is changed over to cut off after the predetermined time period elapses, it is necessary to prepare two circuit systems for the power supply portion or the power supply circuit and further to prepare controls for controlling the above two circuit systems. Therefore, the cost of the circuit apparatus becomes high. These are also problems solved by the present invention.

Furthermore, in order to shorten the rising-up time of the fixing apparatus of the self-heat-emitting type heating roller which is not sufficiently short, it is a matter of course that the heat emitting efficiency of the above-mentioned heating roller itself has to be raised. Hereupon, there arises a problem how to effectively consume the limited power in the apparatus.

However, as mentioned before, if the consumed power immediately after turning on the power supply is brought to the utmost close to the maximum power capable of being supplied to the fixing apparatus, since the resistor employed in the self-heat-emitting type heating roller has a positive resistance characteristic in which the resistance value becomes large in accordance with the rising-up of the temperature, there arises a problem that, at a low temperature, the resistance value becomes low, and thereby an excessive current tends to flow through the fixing apparatus.

Generally, in the electrophotographic apparatus, although the storage temperature and the use environment (temperature) are previously determined, the storage temperature is allowed to fall to a considerably lower temperature compared with the case of the working (use) environment. In a case that the apparatus is put in a low storage temperature and is transported to the working (use) environment and the power supply is turned on immediately thereafter, the temperature in the interior of the apparatus does not rise up sufficiently and thereby an excessive current flows through the fixing apparatus. On the worst occasion, there arises a fear of damaging the apparatus. These are also problems solved by the present invention.

Furthermore, for instance, in a case that, in the winter season, the temperature in the apparatus reaches the working (use) environmental temperature on the condition that the room (space) equipped with the electrophotographic apparatus is air-conditioned (warmed), while the temperature in the apparatus does not reach the working (use) environmental temperature on the condition that the room (space) equipped with the electrophotographic apparatus is not air-conditioned (warmed), or in a case that the power supply is turned on at a temperature lower than the working (use) environmental temperature, there arises also similar problems.

In such circumstances as mentioned heretofore, although it is not impossible to select a resistor material capable of improving the positive characteristic of the resistance value, the cost turns out to be increased inevitably.

The present invention has been made in consideration of the above-mentioned actual circumstances and troublesome matters to be solved.

It is therefore an object of the present invention to solve the points at issue as mentioned heretofore.

It is another object of the present invention to provide a novel electrophotographic apparatus of low cost capable of shortening a rising-up time.

It is still another object of the present invention to provide a novel electrophotographic apparatus including a fixing apparatus constructed with a simple and low-cost circuit structure which is capable of causing current to flow through a heat emitting resistor to a maximum electric power consumed in the electrophotographic apparatus and which is further capable of shortening the rising-up time of the heating roller type fixing apparatus.

It is still another object of the present invention to provide a novel electrophotographic apparatus including a fixing apparatus constructed with a simple and low-cost circuit structure which is capable of turning on the power supply even on the condition that the temperature in the apparatus does not rise up sufficiently without damaging the apparatus.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
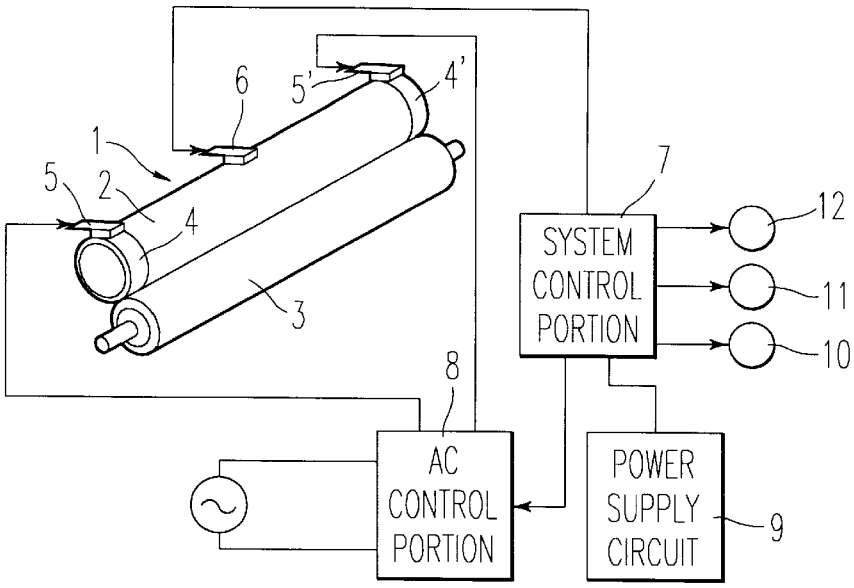
FIG. 1 is an outlined perspective view of a thermal-roller fixing apparatus of a first embodiment according to the present invention.

In order to attain the objects of the present invention described heretofore, the present invention proposes an electrophotographic apparatus including a thermal-roller fixing apparatus, in which a heating roller included in the thermal-roller fixing apparatus is a self-heat-emitting type heating roller performing a heating operation by supplying electricity to a heat emitting resistor contained therein, and in which the heat emitting resistor has a positive temperature characteristic.

Assuming that a maximum specified electric power of an electrophotographic apparatus is $W_{max}$, a power consumption in a control circuit board for controlling a load excluding the thermal-roller fixing apparatus, a power supply circuit, etc., at a time of non-driving is $W_s$, a power consumption in a control circuit board for controlling drive load excluding the thermal-roller fixing apparatus at a time of driving, power supply circuit, motor, and clutch is $W_m$, a lower-limit temperature employed in the electrophotographic apparatus is $T_0$, a resistance value of the heat emitting resistor at the temperature $T_0$ is $R_0$, a temperature at the time of starting driving of the heating roller is $T_2$, a resistance value of the heat emitting resistor at the temperature $T_2$ is $R_2$, a temperature for controlling a fixing operation by the heating roller is $T_3$, a resistance value of the heat emitting resistor at the temperature $T_3$ is $R_3$, an average power consumption of the thermal-roller fixing apparatus in the range from the lower-limit temperature $T_o$ employed in the electrophotographic apparatus to the temperature $T_3$ for controlling the fixing operation by the heating roller is $W_1$, and a voltage supplied to the thermal-roller fixing apparatus is V, the temperature $T_2$ at the time of starting driving of the heating roller is set and the heat emitting resistor is selected, so as to satisfy the following inequalities:

$$V^2/R_3 \leqq /V^2/R_2 < W_{max} - W_m \leqq W_1 < V^2/R_0 \leqq W_{max} - W_s.$$

The present invention further proposes an electrophotographic apparatus as defined heretofore, in which the temperature $T_2$ at the time of starting driving of the heating roller is set and the heat emitting resistor is selected, such that the design center value of the resistance value $R_2$ of the heat emitting resistor satisfies the following inequality:

$$(W_{max} - W_m)/(V^2/R_2) \geqq 1.05.$$

The present invention further proposes an electrophotographic apparatus as defined heretofore, in which assuming that, when recording paper of a maximum size is successively fed, power consumption of the thermal-roller fixing apparatus needed for the fixing operation is $W_f$, the heat emitting resistor is selected such that the resistance value $R_3$ of the heat emitting resistor satisfies the following inequality:

$$V^2/R_3 \geqq W_f.$$

The present invention further proposes an electrophotographic apparatus as defined heretofore, in which the heat emitting resistor is selected, such that the design center values of the resistance values $R_3$ and $R_0$ of the heat emitting resistor satisfy the following inequality:

$$R_3 \geqq 1.13\ R_0.$$

The present invention further proposes an electrophotographic apparatus as defined heretofore, in which, assuming that the resistance value of the heat emitting resistor at temperature $T_1=(T_0+T_3)/2$, the drive starting temperature $T_2$ is set and the heat emitting resistor is selected on the condition that the value of the average power consumption of the thermal-roller fixing apparatus is replaced to $V^2/R_1$.

The present invention further proposes an image forming apparatus in an electrophotographic apparatus provided with a fixing apparatus employing a self-heat-emitting type heating roller, in which a heat emitting resistor mounted on the surface layer of the heating roller has a positive temperature characteristic, in which, assuming that maximum electric power supplied to a fixing apparatus in the image forming apparatus is $W'_{max}$, a lower-limit temperature employed in the image forming apparatus is $T_0$, a resistance value of the fixing apparatus at the temperature $T_0$ of the heating roller is $R_0$, and a standard voltage applied to the fixing apparatus is V, a condition of the fixing apparatus is set so as to satisfy the following inequality:

$$V^2/R_0 \leqq W'_{max}$$

in which the image forming apparatus further includes a temperature detection unit for detecting the surface temperature of the heating roller, and in which the standard voltage and a higher applied voltage higher than the standard applied voltage are not applied to the heating roller until the roller surface temperature detected by the temperature detection unit becomes higher than the lower-limit temperature $T_0$ employed in the image forming apparatus.

The present invention further proposes an image forming apparatus in an electrophotographic apparatus provided with a fixing apparatus employing a self-heat-emitting type heating roller, in which a heat emitting resistor mounted on a surface layer of the heating roller has a positive temperature characteristic, in which, assuming that maximum electric power supplied to a fixing apparatus in the image forming apparatus is $W'_{max}$, a lower-limit temperature employed in the image forming apparatus is $T_0$, a resistance value of the fixing apparatus at the temperature $T_0$ of the heating roller is $R_0$, and a standard voltage applied to the fixing apparatus is V, a condition of the fixing apparatus is set so as to satisfy the following inequality:

$$V^2/R_0 \leqq W'_{max}$$

in which the image forming apparatus further includes a temperature detection unit for detecting a surface temperature of the heating roller, and in which, assuming that the resistance value at a certain temperature of the heating roller is R(T), the standard voltage and a higher applied voltage higher than the standard voltage are not applied to the heating roller until the roller surface temperature detected by the temperature detection unit becomes higher than the temperature T satisfying the following equation:

$$V^2/R(T) = W'_{max}.$$

The present invention further proposes an image forming apparatus in an electrophotographic apparatus provided with a fixing apparatus employing a self-heat-emitting type heating roller, in which a heat emitting resistor mounted on a surface layer of the heating roller has a positive temperature characteristic, in which, assuming that maximum electric power supplied to a fixing apparatus in the image forming apparatus is $W'_{max}$, a lower-limit temperature employed in the image forming apparatus is $T_0$, a resistance value of the fixing apparatus at the temperature $T_0$ of the heating roller is $R_0$, and a standard voltage applied to the fixing apparatus is V, a condition of the fixing apparatus is set so as to satisfy the following inequality:

$$V^2/R_0 \leqq W'_{max}$$

in which the image forming apparatus further includes a temperature detection unit for detecting a temperature at a neighborhood of the heating roller, and in which the standard voltage and a higher applied voltage higher than the standard voltage are not applied to the heating roller until the temperature at the neighborhood of the heating roller detected by the temperature detection unit becomes higher than the lower-limit temperature $T_0$ employed in the image forming apparatus.

The present invention further proposes an image forming apparatus in an electrophotographic apparatus provided with a fixing apparatus employing a self-heat-emitting type heating roller, in which a heat emitting resistor mounted on a surface layer of the heating roller has a positive temperature characteristic, in which, assuming that maximum electric power supplied to a fixing apparatus in the image forming apparatus is $W'_{max}$, a lower-limit temperature employed in the image forming apparatus is $T_0$, a resistance value of the fixing apparatus at the temperature $T_0$ of the heating roller is $R_0$, and a standard voltage applied to the fixing apparatus is V, a condition of the fixing apparatus is set so as to satisfy the following inequality:

$$V^2/R_0 \leqq W'_{max}$$

in which the image forming apparatus further includes a temperature detection unit for detecting a temperature at a neighborhood of the heating roller, and in which, assuming that the resistance value at a certain temperature of the heating roller is R(T), the standard voltage and a higher applied voltage higher than the standard voltage are not applied to the heating roller until the temperature at the neighborhood of the heating roller detected by the temperature detection unit becomes higher than the temperature T satisfying the following equation:

$$V^2/R(T)=W'_{max}.$$

The present invention further proposes an image forming apparatus in an electrophotographic apparatus provided with a fixing apparatus employing a self-heat-emitting type heating roller, in which a heat emitting resistor mounted on a surface layer of the heating roller has a positive temperature characteristic, in which, assuming that maximum electric power supplied to a fixing apparatus in the image forming apparatus is $W'_{max}$, a lower-limit temperature employed in the image forming apparatus is $T_0$, a resistance value of the fixing apparatus at the temperature $T_0$ of the heating roller is $R_0$, and a standard voltage applied to the fixing apparatus is V, a condition of the fixing apparatus is set so as to satisfy the following inequality:

$$V^2/R_0 \leqq W'_{max}$$

in which the image forming apparatus further includes a detection unit for detecting the resistance value of the heating roller or a substitution characteristic thereof, and in which the standard applied voltage and a higher applied voltage higher than the standard applied voltage are not applied to the heating roller until the resistance value of the heating roller or the substitution characteristic thereof becomes higher than the resistance value R satisfying the following equation:

$$V^2/R_0 \leqq W'_{max}$$

The present invention further proposes an image forming apparatus as defined heretofore, in which the heating roller is not applied with electricity during the time period when the standard voltage and a higher applied voltage higher than the standard voltage are not applied to the heating roller.

The present invention further proposes an image forming apparatus as defined heretofore, in which the heating roller is applied with an applied voltage lower than the standard voltage V during the time period when the standard voltage and higher applied voltage higher than the standard voltage are not applied to the heating roller.

The present invention further proposes an image forming apparatus as defined heretofore, in which, assuming that an applied voltage lower than the standard voltage V is $V_L$, a resistance value of the fixing apparatus at the storage lower-limit temperature of the image forming apparatus is $R_L$, and a tolerable maximum current value of the circuit in the fixing apparatus of the image forming apparatus is Imax, the applied voltage $V_L$ is set so as to satisfy the following inequalities:

$$V_L < \text{Imax } R_L$$

and $$V_L^2/R_L < W'_{max}.$$

Many parts of a configuration of a thermal-roller fixing apparatus in this embodiment of the present invention are the same as those of a background device. Therefore, an explanation of the same parts as those of a background device is omitted by using the same reference numerals, and primarily different parts are described below.

In the embodiment of this invention shown in FIG. 1, there are shown a thermal-roller fixing apparatus 1, a heating roller 2, a pressurizing roller 3, electrode portions 4 and 4', power supplying portions 5 and 5', a thermistor 6, a system control portion 7, an AC control portion 8, a circuit power supply portion 9, a motor 10, a solenoid 11 and a clutch 12. In such a configuration, a temperature control of the heating roller 2 is the same as in the background device.

A heat emitting resistor in the thermal-roller fixing apparatus 1 of the present invention has positive temperature characteristics, and is manufactured such that the resistor has desired resistance-temperature characteristics decided by, for example, pure silver paste or alloy material such as silver alloy and their mixing ratio. The resistance-temperature characteristics satisfy an inequality as shown below for the material of the above heat emitting resistor.

Assuming that $W_{max}$ is a maximum specified electric power of the electrophotographic apparatus, $W_s$ is power consumption in a control circuit board for controlling a load excluding the thermal-roller fixing apparatus 1 at a time of non-driving and in power supply circuit 9 or the like, $W_m$ is power consumption in a control circuit board for controlling drive load excluding the thermal-roller fixing apparatus 1 at a time of driving, power supply circuit 9, motor 10, solenoid 11, clutch 12, and an exposing lamp etc., $T_0$ is a lower-limit temperature employed in the electrophotographic apparatus, $R_0$, is a resistance value of the heat emitting resistor at the temperature $T_0$, $T_2$ is a temperature at the time of starting the driving of the heating roller 2, $R_2$ is a resistance value of the heat emitting resistor at the temperature $T_2$, $T_3$ is a temperature for controlling a fixing operation by the heating roller 2, $R_3$ is a resistance value of the heat emitting resistor at the temperature $T_3$, $W_1$ is an average power consumption of the thermal-roller fixing apparatus 1 in the range from the lower-limit temperature $T_0$ employed in the electrophotographic apparatus to the temperature $T_3$ for the controlling fixing operation by the heating roller 2, and V is a voltage supplied to the thermal-roller fixing apparatus 1, the temperature $T_2$ is previously set so as to satisfy the following inequalities and a material and a shape of the heat emitting resistor are determined so as to obtain a desired heat emitting capacity:

$$V^2/R_3 \leqq /V^2/R_2 < W_{max} - W_m \leqq W_1 < V^2/R_0 \leqq W_{max} - W_s.$$

Figure 2:
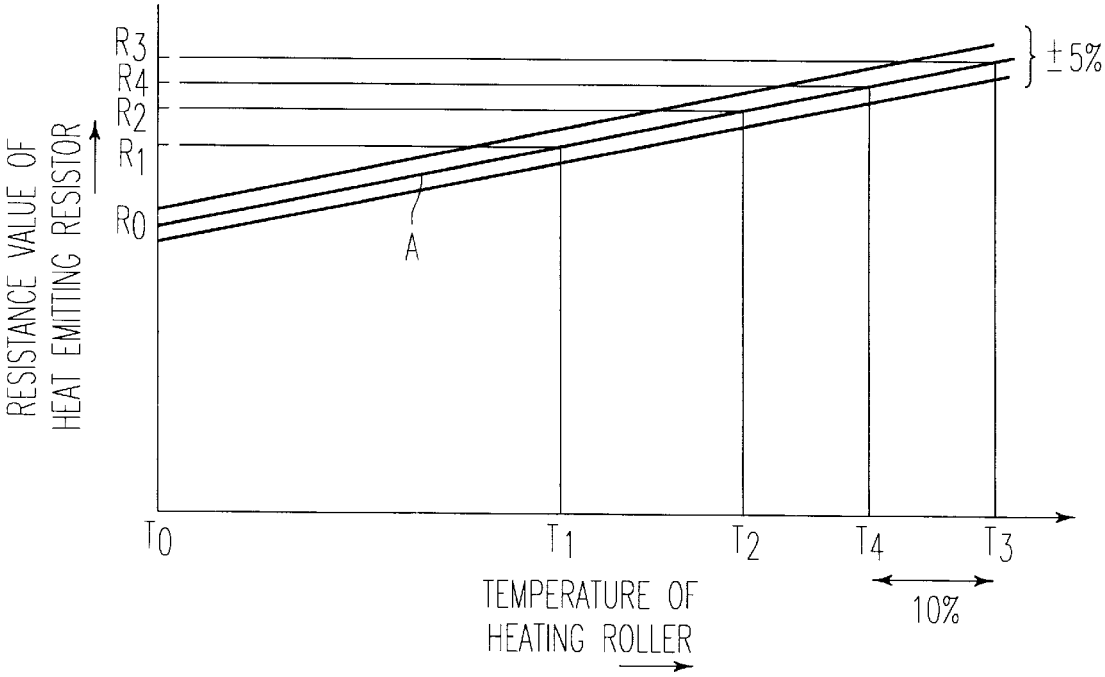
FIG. 2 is a property diagram showing a relationship between a temperature of a heating roller and a resistance value of a heat emitting resistor.

In the above inequalities for this configuration, the factors, V, $W_s$, $W_{max}$, $W_m$, $T_3$ indicating a fixing control temperature which is an upper-limit temperature of a copy of the heating roller 2, and $T_0$ (an environmental temperature in winter is adopted) are already determined based on a using environment and a type of the apparatus so as not to have any degree of freedom, while the resistance values $R_3$ and $R_0$, of the heat emitting resistor are limited to each range according to the above conditions naturally. Therefore, an inclination of the resistance temperature characteristics is specified as shown in FIG. 2 so that the resistance values $R_3$ and $R_0$, are within the range as determined above, and a material of a heat emitting resistor (A) having the specified resistance-temperature characteristics is selected, and then a sectional area square measure and a length of the heat emitting resistor (A) are determined so as to obtain a predetermined heat emitting amount. Coefficients of the resistance temperature have linear positive characteristics or minute non-linear positive characteristics depending on the selected material of the heat emitting resistor (A). One coefficient is selected appropriately from the above coefficients.

Next, assuming that a resistance value is on a resistance value characteristic line between $R_0$ and $R_3$ and $T_3$ and $T_0$, $T_2$ is arbitrarily set to be regarded as a drive starting temperature. This drive starting temperature $T_2$ is normally set at a point slightly higher than a middle point between $T_0$ and $T_3$, and it is used as a temperature point where a pre-rotation can be started to unify a peripheral surface temperature of the heating roller 2 by bringing the pressurizing roller 3 into contact with the heating roller 2 or as a temperature point where a fixing operation can be started. In addition, the drive starting temperature $T_2$ is used as a temperature condition for selecting a material of the heat emitting resistor (A).

Figure 3:
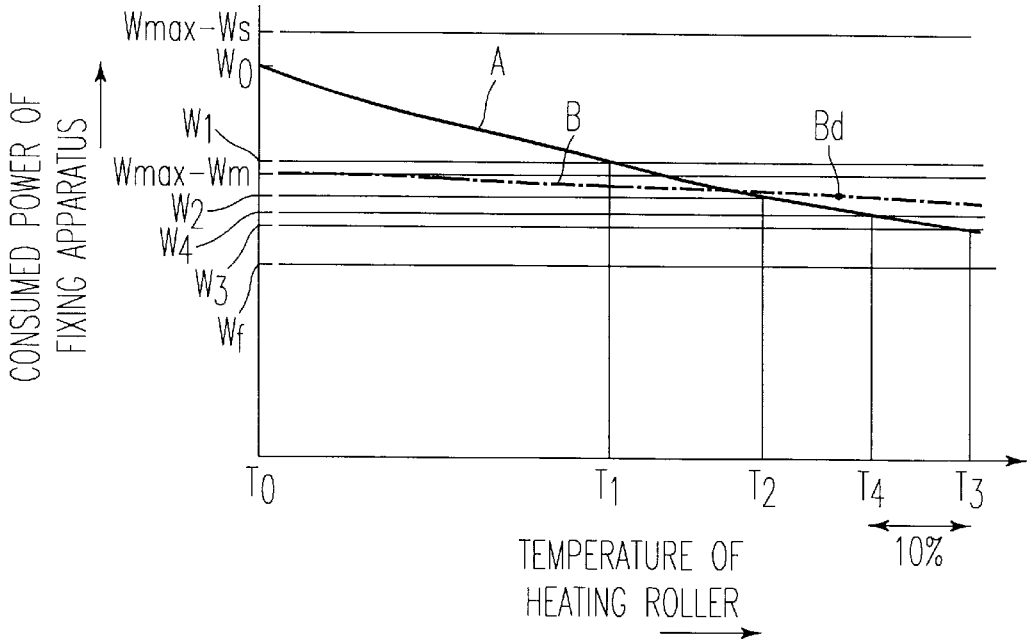
FIG. 3 is a property diagram showing a relationship between a temperature of a heating roller and a consumed power of the thermal-roller fixing apparatus.

A relationship between a temperature of the heating roller 2 including the heat emitting resistor (A) selected as described above and a power consumption of the thermal-roller fixing apparatus 1 is as shown in FIG. 3. In FIG. 3, the following inequalities are satisfied;

$$V^2/R_3 \leqq /V^2/R_2 < W_{max} - W_m \leqq W_1 < V^2/R_0 \leqq W_{max} - W_s.$$

where Wn (n=0, 1, 2, 3, 4)=$V^2$/Rn, line A indicates change characteristics of a power consumption of the thermal-roller fixing apparatus 1 including the heat emitting resistor (A) of this invention versus a temperature of the heating roller 2, and line B indicates change characteristics of a power consumption of the thermal-roller fixing apparatus 1 including a background heat emitting resistor (B) versus a temperature of the heating roller 2.

In the above relationship, it is considered that a temperature of the heating roller 2 is $T_0$ or greater when a lower-limit temperature employed in the electrophotographic apparatus is $T_0$. This is because, if a power supply cord is inserted into a power supply outlet, slight power consumption occurs in a maintenance circuit and a temperature inside the machine is slightly higher than an ambient atmosphere temperature. Power consumption of the thermal-roller fixing apparatus 1, however, is $V^2/R_0$ immediately after the power supply switch is turned on. This value is set to be smaller than the maximum electric power ($W_{max}$–$W_s$) which can be consumed at the time of non-driving of the thermal-roller fixing apparatus 1 obtained by subtracting power consumption $W_s$ of a load (the control circuit board, the circuit power supply, etc.) excluding the thermal-roller fixing apparatus 1 at the time of non-driving from the maximum specified electric power $W_{max}$ of the electrophotographic apparatus.

In addition, since the temperature $T_2$ is set for starting driving of the apparatus, power consumption at starting of the driving of the thermal-roller fixing apparatus 1 is $W_2=V^2/R_2$. This value is set to be smaller than the maximum electric power ($W_{max}$–$W_m$) which can be consumed at the time of driving obtained by subtracting power consumption $W_m$ of a load (the control circuit board, the circuit power supply, etc.) and a driving load (the motor 10, the solenoid 11, the clutch 12, the exposing lamp, etc.) excluding the thermal-roller fixing apparatus 1 at the time of driving from the maximum specified electric power of the electrophotographic apparatus $W_{max}$. Further, an average power consumption $W_1$ of the thermal-roller fixing apparatus 1 from the lower-limit temperature $T_0$ employed in the electrophotographic apparatus to the fixing control temperature $T_3$ is set to be greater than the maximum electric power ($W_{max}$–$W_m$) which can be consumed at the time of driving obtained by subtracting a power consumption $W_m$ of a driving load excluding the thermal-roller fixing apparatus 1 at the time of driving from the maximum specified electric power $W_{max}$ of the electrophotographic apparatus.

Therefore, an average power consumption can be increased without fail compared with an average power consumption (point Ba in FIG. 3) of the thermal-roller fixing apparatus 1 including a background heating roller 2, and power is supplied to the thermal-roller fixing apparatus 1 efficiently and an initial rising-up time for copying can be decreased. In addition, the power consumption of the thermal-roller fixing apparatus 1 at the fixing control temperature $T_3$ of the heating roller 2 in the electrophotographic apparatus is naturally smaller than the power consumption $W_2$ of the thermal-roller fixing apparatus 1 at the temperature $T_2$ at the time of starting the drive of the apparatus, and $W_3=V^2/R_3$.

Assuming that $W_f$ is power consumption of the thermal-roller fixing apparatus 1 required for fixing continuous recording paper when a recording paper of a maximum size is successively fed, a material and a shape of the heat resistor (A) are determined such that the values of $W_3=V^2/R_3$ satisfy an inequality, $V^2/R_3 \leqq W_f$. Therefore, faulty fixing does not occur also when continuous recording paper is successively fed.

As shown in FIG. 2 illustrating a relationship between a temperature and a resistance value of the heating roller 2, an almost straight line is shown as the relationship between the temperature and the resistance value at 0° C. to 200° C. normally employed in the electrophotographic apparatus. When pure silver or silver alloy is used for the heat emitting resistor (A), the heat emitting resistor (A) made of the material generates approximately ±5% unevenness of its resistance value at the time of manufacturing. Therefore, the heat emitting resistor (A) is selected by determining the drive starting temperature $T_2$, the resistance value $R_2$ of the heat emitting resistor (A), the material, and a design center value of the shape so as to satisfy an inequality, $(W_{max}-W_m)/(V^2/R_2) \geqq 1.05$. The power consumption does not exceed a tolerance electric power even if the resistance value of the heat emitting resistor (A) is uneven.

Figure 4:
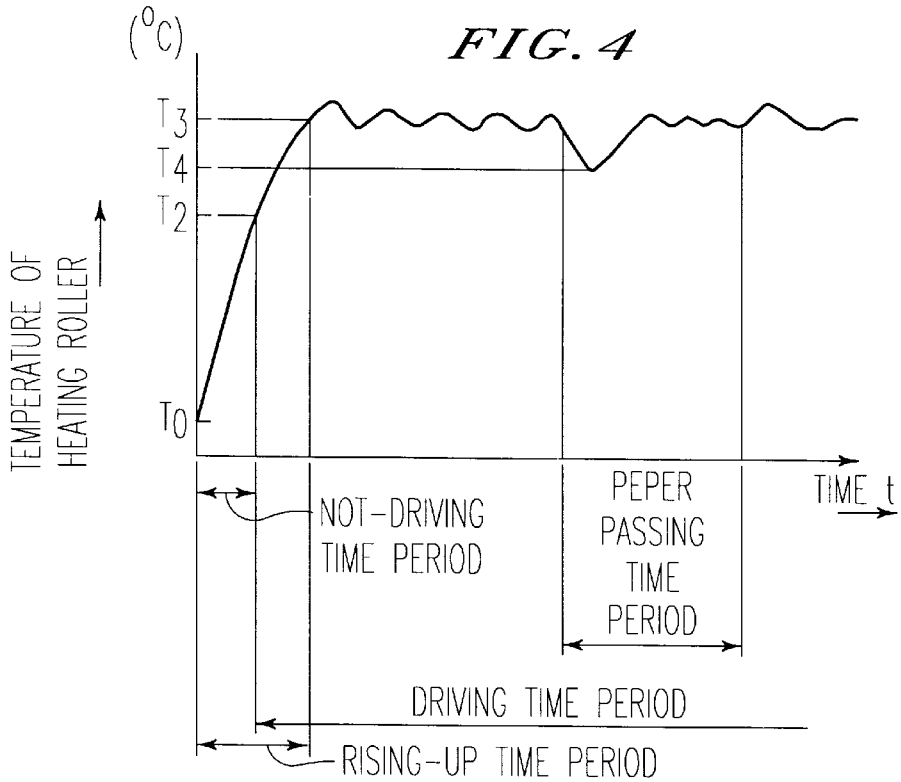
FIG. 4 is a property diagram showing a temperature variation of a heating roller at a time of rising up in the thermal-roller fixing apparatus.
Figure 5:
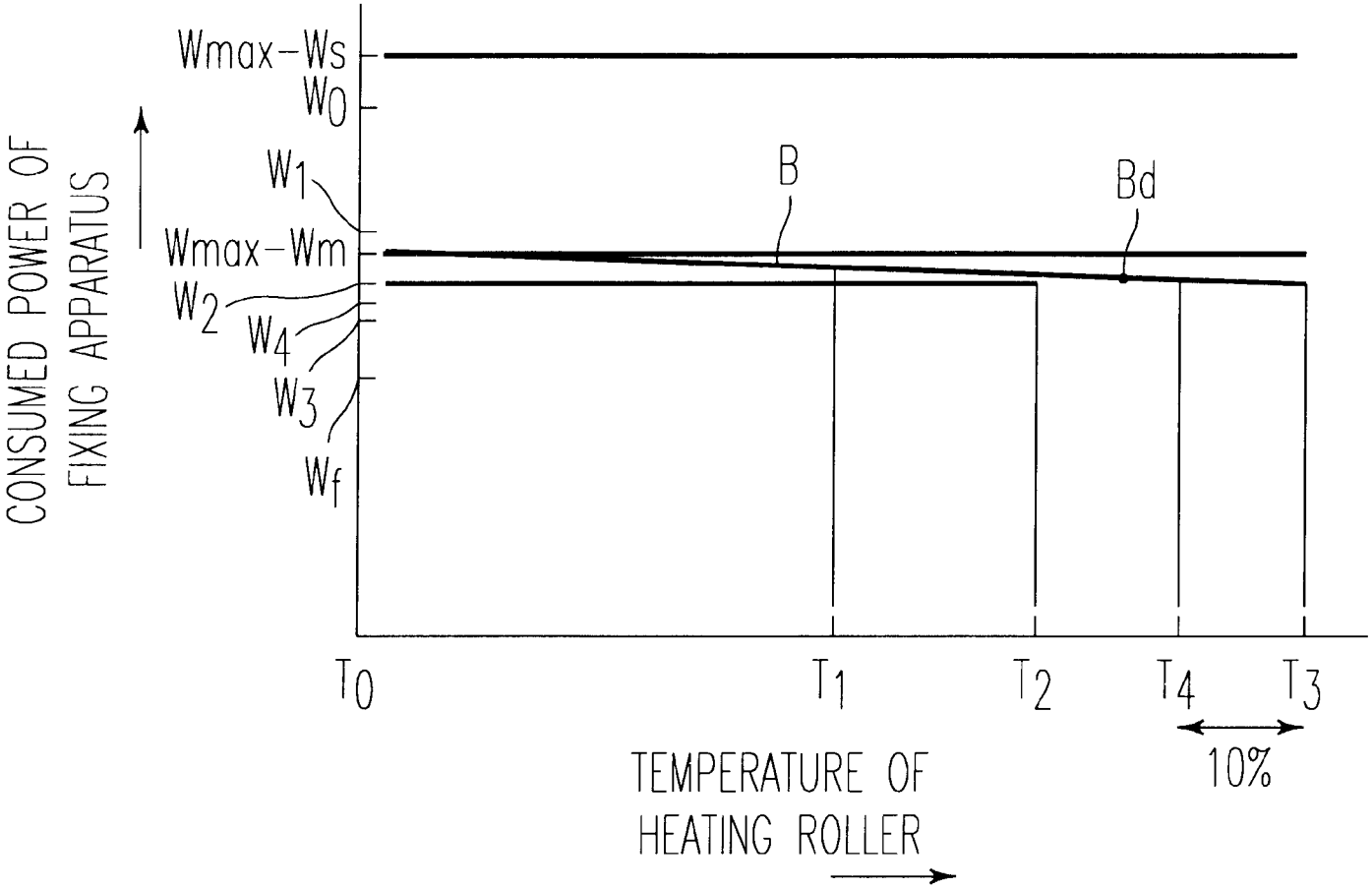
FIG. 5 BACKGROUND ART
FIG. 5 is a property diagram showing a background relationship between a temperature of a heating roller and a consumed power of a fixing apparatus.

In FIG. 4 illustrating a temperature change of the heating roller 2 at a start of the thermal-roller fixing apparatus 1, when paper feeding is started, a temperature of the heating roller 2 is decreased to a temperature of approximately $T_4$=0.9T3 from the fixing control temperature $T_3$ since heat is taken away (removed) by paper to some extent. Also at this temperature, the power consumption $W_4$ of the thermal-roller fixing apparatus 1 at the time of driving must also be previously set to be smaller than a maximum electric power which can be consumed at a time of driving obtained by subtracting the power consumption $W_m$ of a driving load excluding the thermal-roller fixing apparatus 1 at the time of driving from the maximum specified electric power $W_{max}$ of the electrophotographic apparatus. In addition, since the resistance value of the heat emitting resistor (A) is uneven, the following inequality must be satisfied:

$$(W_{max}-W_m)/W_4 \geqq 1.05 (W_4=V^2/R_4).$$

Furthermore, power consumption of the thermal-roller fixing apparatus 1 immediately after turning on the power supply switch is $V^2/R_0$, and in the same manner, its power consumption must have a relationship with the maximum power consumption which can be consumed at a time of non-driving of the specified device obtained by subtracting the power consumption $W_s$ of a load excluding the thermal-roller fixing apparatus 1 at the time of non-driving from the maximum specified power consumption $W_{max}$ of the electrophotographic apparatus:

$$(W_{max}-W_s)/W_0 \geqq 1.05 (W_0=V^2/R_0).$$

Still further, a relationship between $R_0$, and $R_3$ is expressed by $R_3 \geqq 1.13R_0$ assuming that $W_{max}-W_m \leqq W_1=V^2/R_1$ such that an average power consumption $W_1$ at the time of starting the apparatus becomes preferable. Since the heat emitting resistor (A) is selected by determining a design center value of the resistance value of the heat emitting resistor (A) as described above, the power consumption does not exceed the maximum specified electric power so as to obtain favorable starting characteristics at the time of a fixing operation also under conditions that a temperature of the heating roller 2 is decreased to some extent due to heat absorption by paper and a resistance value of the heat emitting resistor (A) is uneven.

In the above embodiment of this invention, instead of the average power consumption $W_1$, $V^2/R_1$ can be adopted assuming that $R_1$ indicates a resistance value of the thermal-roller fixing apparatus 1 at a temperature, $T_1=(T_0+T_3)/2$. In other words, since a transition curve of the power consumption is an almost straight line which is downward to the right as shown in FIG. 3, there is not much difference even if the average power consumption $W_1$ is replaced with $V^2/R_0$, to obtain the value assuming that $R_1$ indicates a resistance value of the thermal-roller fixing apparatus at a temperature, $T_1=(T_0=T_3)/2$. Therefore, an equivalent result can be obtained more easily without performing any complicated calculation to obtain the average power consumption $W_1$, a drive starting temperature $T_2$ can be previously set, and a resistance value, material, and shape of the heat emitting resistor (A) can be determined and selected.

A second embodiment of this invention is now described below with reference to the accompanying drawings.

Figure 6:
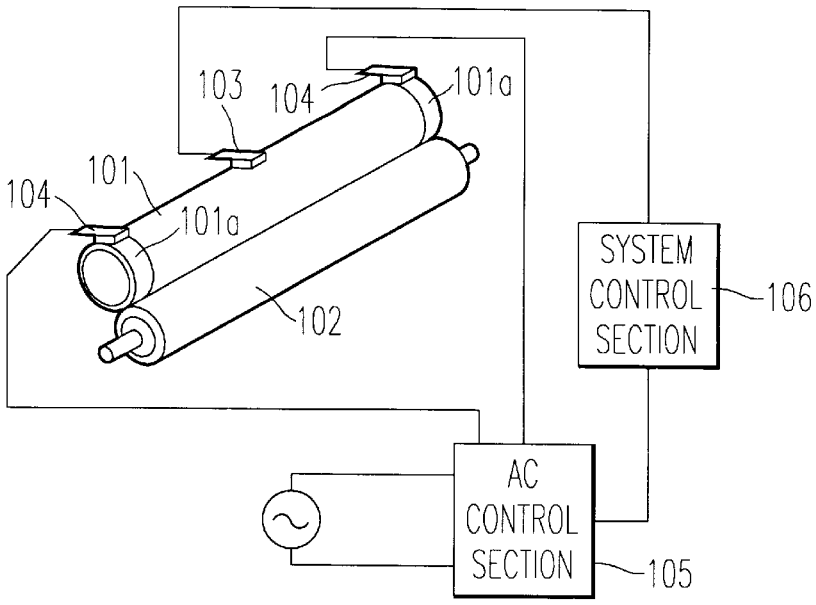
FIG. 6 is an explanatory view showing a fixing apparatus and a control system thereof in an electrophotographic apparatus of a second embodiment according to the present invention.

FIG. 6 shows a fixing apparatus and its control system in this embodiment of the electrophotographic apparatus of this invention. The fixing apparatus shown in FIG. 6 includes a self-heat-emitting type heating roller 101, a pressing roller 102 brought into contact with the heating roller 101 with pressure, a thermistor 103 for detecting a temperature of the heating roller 101, feeding sections 104 for supplying electric power to the heating roller 101, and a unit case which is not shown. The heating roller 101 has electrode sections 101*a* at its both ends, and the feeding sections 104 are arranged in contact with the electrode sections 101*a*. The thermistor 103 is in contact with the heating roller 101.

In the main body of the electrophotographic apparatus, there are provided an AC control section 105 and a system control section 106. From the AC control section 105 connected to an alternating power supply, an electric power is supplied to the heating roller 101 via the feeding section 104. Additionally, a temperature of the heating roller 101 detected by the thermistor 103 is entered (inputted) into the system control section 106, and a power supply to the heating roller 101 is controlled by the AC control section 105 based on an ON/OFF signal generated by the system control section 106 according to the detected temperature of the heating roller 101.

As to a temperature control of the heating roller 101 performed at the time of executing a fixing operation, either a general ON/OFF control in which energizing is set ON or OFF when the temperature is increased or decreased by predetermined degrees from an arbitrarily-set temperature or a phase control in which a duty ratio (cycle) of ON/OFF depends on a difference from an arbitrarily-set temperature can be used.

In the system control section 106, a sequence control of the entire electrophotographic apparatus is performed in addition to the temperature control of the heating roller 101. Naturally, an ON/OFF timing is also controlled for a driving system including a fixing apparatus driving system. An explanation of these controls is omitted since they are the same as those of a general electrophotographic apparatus.

Figure 7:
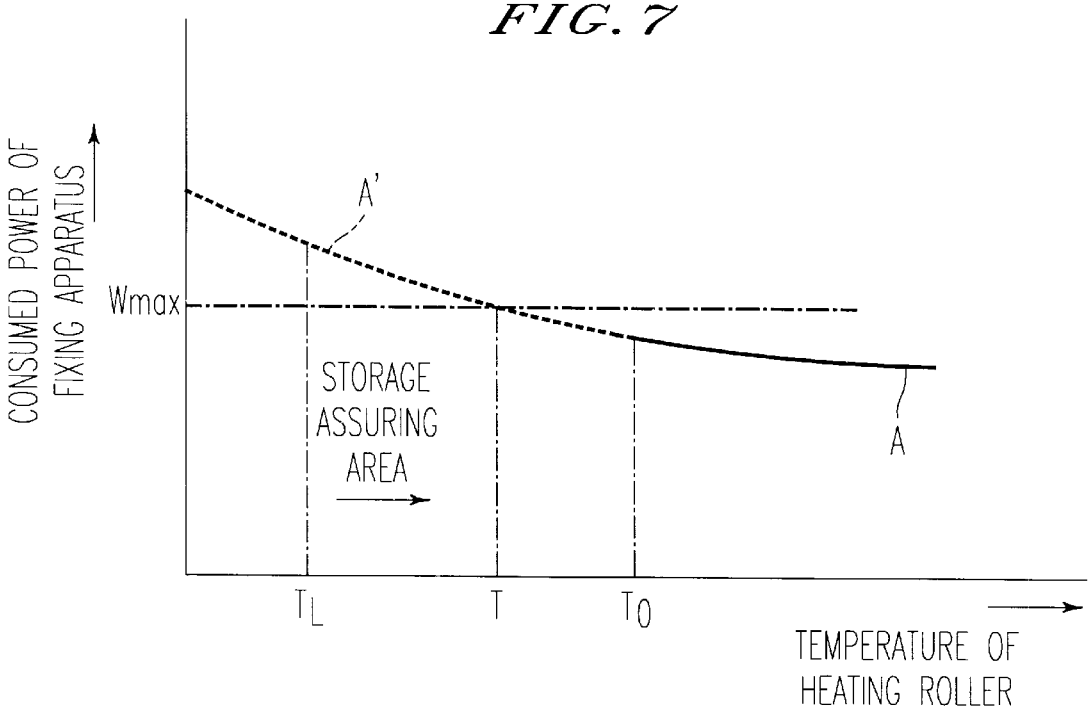
FIG. 7 is a graph showing a relationship between a temperature of a heating roller and a consumed power of a fixing apparatus.

FIG. 7 is a graph illustrating a relationship between power consumption of the fixing apparatus and a temperature of the heating roller 101 in the electrophotographic apparatus of this embodiment. In FIG. 7, temperature $T_0$ is a working lower-limit temperature determined for this apparatus. Temperature $T_1$ is also a storage (lower-limit) temperature determined for this apparatus. Power consumption $W'_{max}$ is a maximum allowable (tolerable) electric power determined for the fixing apparatus of this electrophotographic apparatus.

A resistor used for the self-heat-emitting type heating roller 101 has positive temperature characteristics. Therefore, its resistance value becomes smaller and the current is increased as the temperature decreases. In other words, if an applied voltage is identical, a lower temperature makes the power consumption of the fixing apparatus higher. Accordingly, as indicated by A in FIG. 7, if a standard voltage V is applied to the fixing apparatus, a lower temperature causes higher power consumption. At this point, the power consumption of the fixing apparatus of this embodiment is set so as to be as close as possible to the maximum electric power $W'_{max}$ permitted to the fixing apparatus at the working lower-limit temperature $T_0$ to make its starting characteristics favorable.

Therefore, if a temperature of the heating roller 101 is lower than the working lower-limit temperature $T_0$, the power consumption is increased gradually as indicated by a dashed line A' in FIG. 7, and if the temperature of the heating roller 101 is lower than a temperature T (referred to as "a limit temperature"), the power consumption exceeds the maximum allowable (tolerable) electric power $W'_{max}$. If so, an overcurrent flows into the fixing apparatus and the apparatus may be destroyed in a worst case.

Therefore, in order to prevent the occurrence of the above unfavorable matters in this embodiment, if a surface temperature of the heating roller 101 detected by the thermistor 103 is equal to or lower than the working lower-limit temperature $T_0$, energizing of the heating roller 101 is intercepted (electric power is not supplied) and an error message is displayed on an operator panel (not shown). In other words, until the temperature of the heating roller 101 becomes higher than the working lower-limit temperature $T_0$, it is inhibited to energize the fixing apparatus with a standard or greater applied voltage.

This operation is effective to prevent an overcurrent from flowing into the fixing apparatus, in other words, to prevent a disadvantage that an overcurrent flows into the fixing apparatus when the temperature is low even if the power consumption immediately after turning on the power supply to improve starting characteristics is brought as close as possible to the maximum electric power which can be applied to the fixing apparatus. Therefore, there is no fear of destroying the machine even if the power supply is turned on immediately after bringing the machine from an environment at a low storage temperature to a working environment. In addition, it is possible to prevent the apparatus from being destroyed only with improvements on conducting controls without any specific protective mechanisms, and thereby this does not result in an increase in cost.

Furthermore, as a temperature at which energizing of the fixing apparatus is intercepted, instead of the working lower-limit temperature $T_0$, the above limit temperature T can also be used. The limit temperature T is defined as a temperature which satisfies an equation, $V^2/R(T)=W'_{max}$, where V is a standard applied voltage, $W'_{max}$, is the maximum allowable electric power for the fixing apparatus, and R(T) is a resistance value at a temperature of the heating roller 101. In other words, a temperature T satisfying this equation is defined as a limit temperature T.

Figure 8:
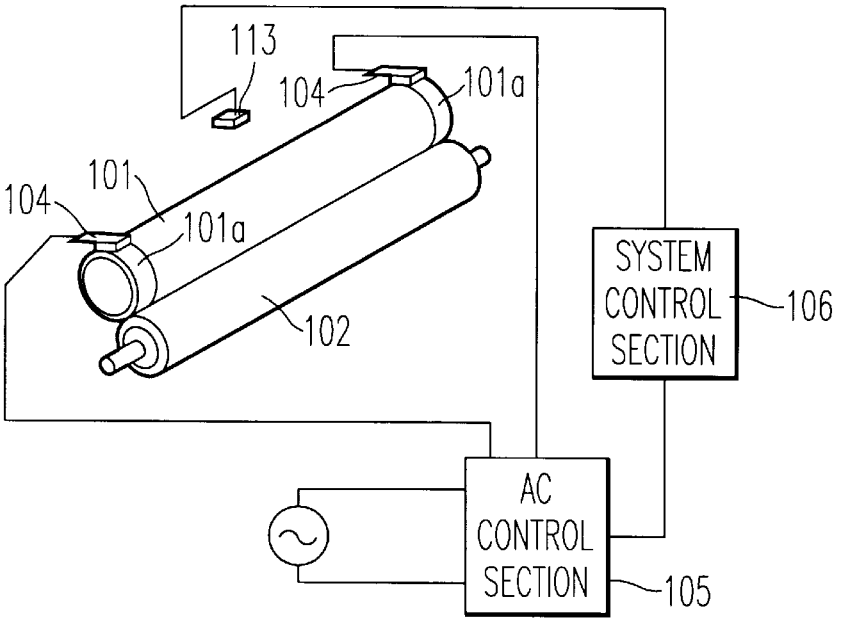
FIG. 8 is an explanatory view showing a fixing apparatus and a control system thereof in an electrophotographic apparatus of a third embodiment according to the present invention.

Next, a third embodiment of this invention is now described below. As shown in FIG. 8, an electrophotographic apparatus of this embodiment includes a thermistor 113 disposed near a heating roller 101 as a thermistor for detecting a temperature of the heating roller 101. As this embodiment is the same as the second embodiment described with reference to FIGS. 6 and 7 except that the thermistor 113 is not in contact with the heating roller 101, a duplicate explanation is omitted.

In general, although a temperature of the heating roller itself is different from its neighboring atmosphere temperature on the condition that the heating roller is heated, they are considered to have a temperature equilibrium in a condition that they have been stored at a low temperature, and therefore, a temperature detected by the thermistor in contact with the heating roller 101 is almost equal to a temperature detected by the thermistor 113 not in contact with the heating roller 101 Accordingly, the same power supply control as that of the second embodiment should be performed based on a temperature detected by the thermistor 113 not in contact with the heating roller 101.

In addition, it is also the same as the control of the second embodiment that the limit temperature T can be employed instead of the working lower-limit temperature $T_0$ as a temperature at which energizing the fixing apparatus is intercepted.

Figure 9:
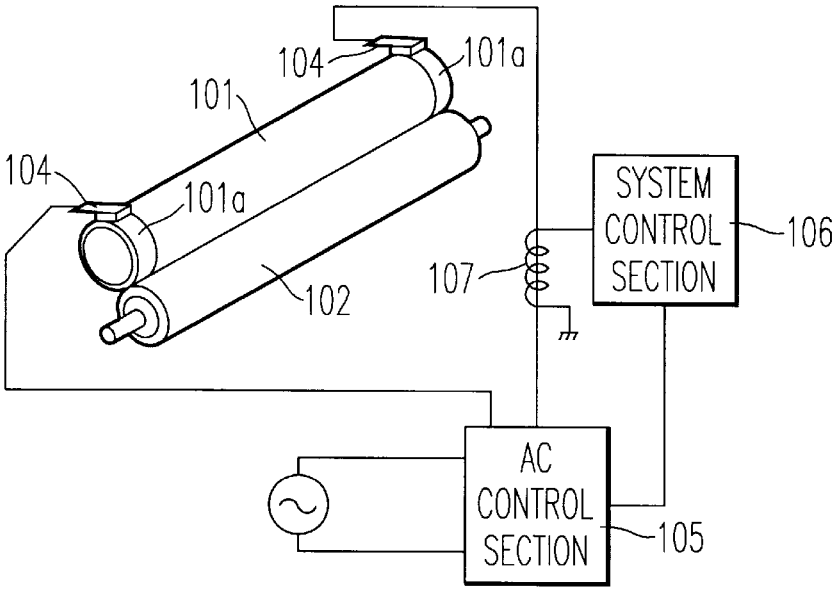
FIG. 9 is an explanatory view showing a fixing apparatus and a control system thereof in an electrophotographic apparatus of a fourth embodiment according to the present invention.

Next, a fourth embodiment of this invention is now described below. As shown in FIG. 9, an electrophotographic apparatus of this embodiment does not include a thermistor for detecting a temperature of the heating roller 101, but the apparatus in this embodiment detects a resistance value or its substitute value to be used for the temperature control, by utilizing a characteristic that a resistance value of the heating roller 101 changes according to temperature.

In other words, a current detecting section 107 is arranged on a conductive wire from an AC control section 105 to one of feeding sections 104, and an induced current generated by a current flowing into the conductive wire is entered (inputted) into a system control section 106. If the resistance value of the heating roller 101 changes, the current flowing into the heating roller 101 also changes. The change of the current is detected as a change of the induced current flowing through the current detecting section 107. In this fourth embodiment, the induced current can be converted to a voltage to detect a change of the resistance value of the heating roller 101 based on the change of the converted value by using the system control section 106.

As to a temperature control of the heating roller 101 at the time of executing a fixing operation, either an ON/OFF control in which energizing is set (turned) ON or OFF when the resistance value detected by the current detecting section 107 is increased or decreased by predetermined degrees (values) from an arbitrarily-set resistance value of the heating roller 101 or a phase control in which a duty ratio (cycle) of ON/OFF depends on a difference from an arbitrarily-set resistance value can be used.

Assuming that V is a standard applied voltage, $W'_{max}$ is the maximum allowable (tolerable) electric power of the fixing apparatus, and R is a resistance value of the heating roller 101, if a resistance value detected by the current detecting section 107 is equal to or smaller than the resistance value R which satisfies $V^2/R=W'_{max}$, energizing of the heating roller 101 is intercepted and an error message is displayed on an operation panel (not shown). In other words, the fixing apparatus is not energized with a standard applied voltage or a higher applied voltage until the resistance value of the heating roller 101 detected by the current detecting section 107 becomes higher than the resistance value R. Effects of this embodiment are the same those of the second embodiment described with reference to FIGS. 6 and 7.

Furthermore, a fifth embodiment of this invention is now described below. In this embodiment, if a temperature or a resistance value of a heating roller 101 is equal to or smaller than a predetermined value, energizing of the heating roller 101 is not intercepted, but the heating roller is energized at a lower voltage than the standard voltage V. Assuming that $V_L$ is a voltage lower than the standard voltage V, any one of the second, third, and fourth embodiments shown in FIGS. 6, 8, and 9 can be used for a configuration for and a method of obtaining a temperature or a resistance value of the heating roller 101 to be compared with a predetermined value (standard value) in order to switch an applied voltage from V to $V_L$.

In other words, by arranging a thermistor brought into contact with or not into contact with the heating roller 101 is disposed, and the heating roller can be energized with the voltage $V_L$ if a temperature detected by the thermistor becomes equal to or lower than the predetermined temperature, or without utilizing a thermistor, the heating roller can be energized with the voltage $V_L$ if a resistance value or its substitute value of the heating roller 101 which has been detected becomes equal to or smaller than a predetermined resistance value.

Figure 10:
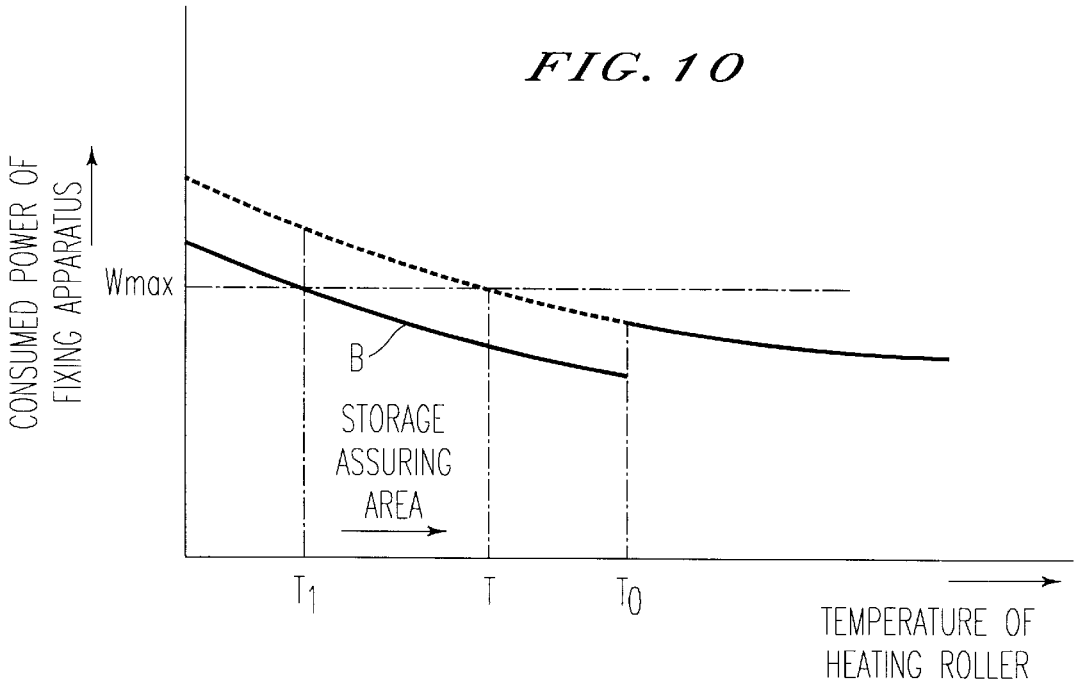
FIG. 10 is a graph showing a relationship between a temperature of a heating roller and a consumed power of a fixing apparatus of a fifth embodiment according to the present invention.

FIG. 10 is a graph illustrating a relationship between the temperature of the heating roller and power consumption of the fixing apparatus at the time of controlling energizing of the fixing apparatus in this embodiment. In the graph of FIG. 10, it is assumed that an applied voltage is switched based on a temperature detected by a thermistor put in contact with or close to the heating roller.

As shown in FIG. 10, if the temperature of the heating roller is higher than the working lower-limit temperature $T_0$, the standard voltage V is applied to the heating roller, and an electric power is consumed. If the heating roller is energized with the standard voltage V when a temperature of the heating roller is equal to or lower than the working lower-limit temperature $T_0$, the power consumption of the fixing apparatus changes as indicated by a dashed line in the graph, and it exceeds the maximum allowable (tolerable) electric power $W'_{max}$ at the limit temperature T or a lower range. Therefore, in this embodiment, if the temperature of the heating roller is equal to or lower than the working lower-limit temperature T0, the heating roller is energized with a voltage $V_L$ lower than the standard voltage V.

In this operation, the power consumption of the fixing apparatus changes as indicated by B in the graph, and it does not exceed the maximum allowable (tolerable) electric ower $W'_{max}$ at a temperature equal to or higher than the storage lower-limit temperature $T_L$, and further an overcurrent does not flow into the fixing apparatus, so that the apparatus is not destroyed.

Hereupon, assuming that $R_L$ is a resistance value of the fixing apparatus at a storage lower-limit temperature of the electrophotographic apparatus and $I_{max}$ is the maximum allowable (tolerable) current value for a circuit related to the fixing apparatus of the electrophotographic apparatus, the heating roller can be gradually heated without damaging the machine reliably if the storage lower-limit temperature is kept by determining the voltage $V_L$ so as to satisfy inequalities, $V_L<I_{max}\cdot R_L$ and $V_L^2/R_L<W'_{max}$. Therefore, it becomes possible to perform preheating from the storage environment and a time for starting the apparatus can be reduced compared with the above embodiments in which the heating roller is not energized when its temperature or resistance value is equal to or lower than the predetermined value.

Figure 11:
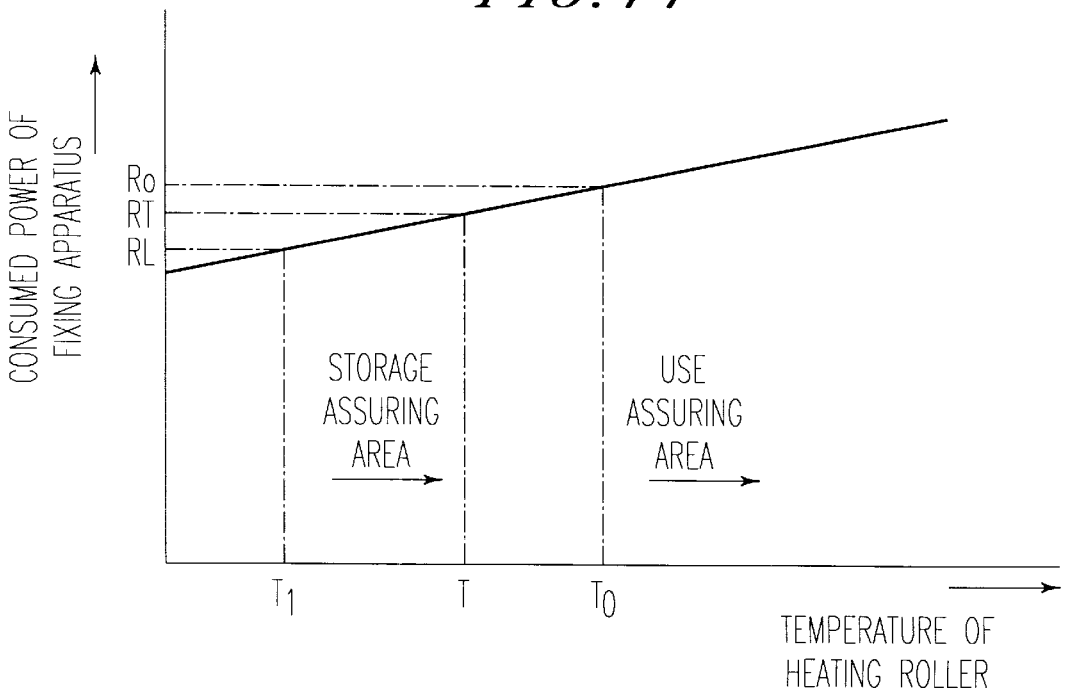
FIG. 11 is a graph showing a progress of a resistance value of a fixing apparatus in relation to a change of a heating roller's temperature.

As a temperature at which the applied voltage to the heating roller is switched from V to $V_L$, the limit temperature T can also be used instead of the working lower-limit temperature $T_0$. In addition, the applied voltage can be switched based on a resistance value or its substitute value (for example, a current value detected by the current detecting section 107 shown in FIG. 9) of the heating roller without disposing a thermistor FIG. 11 is a graph showing how the resistance value of the fixing apparatus changes according to a temperature of the heating roller 101. As shown in the graph of FIG. 11, it can be easily understood that a lower temperature of the heating roller makes the resistance value of the fixing apparatus lower (smaller). The resistance value of the fixing apparatus means a resistance value obtained by adding a resistance value of the heating roller 101 to resistance values of sections other than the heating roller 101, for example, resistance values of the feeding section 104 and a conductive wire from the AC control section 105 to the feeding section 104.

As is apparent from the foregoing description of the first through fifth embodiments according to the present invention, some merits and advantageous functional effects are achieved in the present invention.

In the first embodiment, when the power supply is turned on, the average electric power supplied to the self-heat-emitting resistor can be kept high and the electric power at the time of driving can be kept low, and further the rising-up time of the heating-roller fixing apparatus can be largely shortened by effectively utilizing the electric power. And further, the apparatus does not need any sub-heat-emitting resistor and thereby the cost of the circuit apparatus can be reduced.

Furthermore, the embodiment can expect further advantageous functional effects. Even if unevenness in the property of the heat-emitting resistor exists, the consumed power does not exceed the tolerable power. Even when the successive copying is executed by use of the maximum-size recording paper, unfavorable fixing does not occur. And further, even though the temperature of the heating roller is lowered due to the thermal absorption of the recording paper at the time of the fixing operation and there exists the above unevenness in the resistance value of the heat emitting resistor, the consumed power does not exceed the tolerable power and in addition the rising-up time of the heating-roller fixing apparatus at the time of turning on the power supply is shortened. Furthermore, the value corresponding to the average consumed power can be easily decided without obtaining the average consumed power $W_1$ by performing a complicated calculation.

In the second through fifth embodiments, there is no fear of damaging the machine even though the machine is stocked at a low storage temperature and is transported to a place of a working (use) environment (temperature) and the power supply is turned on immediately thereafter. Because there occurs no troublesome matter that an excessive current flows through the fixing apparatus at the low temperature. Furthermore, the rising-up time of the fixing apparatus is shortened.

Obviously, additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. An electrophotographic apparatus comprising:

a thermal-roller fixing apparatus;

a heating roller included in said thermal-roller fixing apparatus, the heating roller including a heat emitting resistor, wherein said heat emitting resistor has a positive temperature characteristic; and wherein, a maximum specified electric power of said electrophotographic apparatus is $W_{max}$, a power consumption in a control circuit board for controlling a load excluding said thermal-roller fixing apparatus at a time of non-driving is $W_s$, a power consumption in the control circuit board for controlling a drive load excluding said thermal-roller fixing apparatus at a time of driving is $W_m$, a lower-limit temperature employed in said electrophotographic apparatus is $T_0$, a resistance value of said heat emitting resistor at said temperature $T_0$ is $R_0$, a temperature at a time of starting driving of said heating roller is $T_2$, a resistance value of said heat emitting resistor at said temperature $T_2$ is $R_2$, a temperature for controlling a fixing operation by said heating roller is $T_3$, a resistance value of said heat emitting resistor at said temperature $T_3$ is $R_3$, an average power consumption of said thermal-roller fixing apparatus in a range from said lower-limit temperature $T_0$ to said temperature $T_3$ for controlling the fixing operation by said heating roller is $W_1$, and a voltage supplied to said thermal-roller fixing apparatus is V, said temperature $T_2$ at the time of starting driving of said heating roller is set and said heat emitting resistor is selected, so as to satisfy the following inequalities:

$$V^2/R_3 \leqq /V^2/R_2 < W_{max} - W_m \leqq W_1 < V^2/R_0 \leqq W_{max} - W_s.$$

2. An electrophotographic apparatus as defined in claim 1, wherein the heating roller is a self-heat-emitting heating roller.

3. An electrophotographic apparatus as defined in claim 1, wherein said resistance value $R_2$ of said heat emitting resistor satisfies the following inequality:

$$(W_{max} - W_m)/(V^2/R_2) \geqq 1.05.$$

4. An electrophotographic apparatus as defined in claim 1, wherein, when recording paper of a maximum size is successively fed, a power consumption of said thermal-roller fixing apparatus fixing operation is $W_f$, and said resistance value $R_3$ of said heat emitting resistor satisfies the following inequality:

$$V^2/R_3 \geqq W_f.$$

5. An electrophotographic apparatus as defined in claim 1, wherein said resistance values $R_3$ and $R_0$ of said heat emitting resistor satisfy the following inequality:

$$R_3 \geqq 1.13 R_0.$$

6. An electrophotographic apparatus as defined in claim 1, wherein a resistance value of said heat emitting resistor at temperature $T_1=(T_0+T_3)/2$ is $R_1$, said drive starting temperature $T_2$ is set and said heat emitting resistor is selected such that the value of the average power consumption of said thermal-roller fixing apparatus $W_1$ is replaced by $V^2/R_1$.

7. An image forming apparatus in an electrophotographic apparatus comprising:

a fixing apparatus employing a heating roller;

a heat emitting resistor mounted on a surface layer of said heating roller, said heat emitting resistor having a positive temperature characteristic;

wherein, a maximum electric power supplied to said fixing apparatus is $W'_{max}$, a lower-limit temperature employed in said image forming apparatus is $T_0$, a resistance value of said fixing apparatus at temperature $T_0$ of said heating roller is $R_0$, and a standard voltage applied to said fixing apparatus is V, a condition of said fixing apparatus is set so as to satisfy the following inequality:

$$V^2/R_0 \leqq W'_{max}$$

wherein said image forming apparatus further comprises temperature detection means for detecting a surface temperature of said heating roller, and wherein a voltage greater than said standard voltage is not applied to said heating roller until the roller surface temperature detected by said temperature detection means becomes higher than said lower-limit temperature $T_0$.

8. An image forming apparatus as defined in claim 7, wherein the heating roller is a self-heat-emitting heating roller.

9. An image forming apparatus as defined in claim 7, wherein said heating roller is not applied with electricity until the roller surface temperature detected by said temperature detecting means becomes higher than said lower-limit temperature $T_0$.

10. An image forming apparatus as defined in claim 7, wherein said heating roller is applied with a voltage lower than said standard voltage V until the roller surface temperature detected by said temperature detecting means becomes higher than said lower-limit temperature $T_0$.

11. An image forming apparatus as defined in claim 10, wherein, the applied voltage lower than said standard voltage V is $V_L$, a resistance value of said fixing apparatus at a storage lower-limit temperature of said image forming apparatus is $R_L$, and a tolerable maximum current value in the fixing apparatus is $I_{max}$, and said applied voltage $V_L$ is set so as to satisfy the following inequalities:

$$V_L < I_{max} \cdot R_L$$

and $$V_L^2/R_L < W'_{max}.$$

12. An image forming apparatus in an electrophotographic apparatus, comprising:

a fixing apparatus employing a heating roller;

a heat emitting resistor mounted on a surface layer of said heating roller, said heat emitting resistor having a positive temperature characteristic;

wherein, a maximum electric power supplied to the fixing apparatus is $W'_{max}$, a lower-limit temperature employed in said image forming apparatus is $T_0$, a resistance value of said fixing apparatus at temperature $T_0$ of said heating roller is $R_0$, and a standard voltage applied to said fixing apparatus is V, a condition of said fixing apparatus is set so as to satisfy the following inequality:

$$V^2/R_0 \leqq W'_{max}$$

wherein said image forming apparatus further comprises temperature detection means for detecting a surface temperature of said heating roller, and wherein, a resistance value at a temperature of said heating roller is R(T), and a voltage greater than said standard voltage is not applied to said heating roller until the roller surface temperature detected by said temperature detection means becomes higher than the temperature T satisfying the following equation:

$$V^2/R(T) = W'/_{max}.$$

13. An image forming apparatus as defined in claim 12, wherein the heating roller is a self-heat-emitting heating roller.

14. An image forming apparatus as defined in claim 12, wherein said heating roller is not applied with electricity until the roller surface temperature detected by said temperature detecting means becomes higher than said lower-limit temperature $T_0$.

15. An image forming apparatus as defined in claim 12, wherein said heating roller is applied with a voltage lower than said standard voltage V until the roller surface temperature detected by said temperature detecting means becomes higher than said lower-limit temperature $T_0$.

16. An image forming apparatus as defined in claim 15, wherein, the applied voltage lower than said standard voltage V is $V_L$, a resistance value of said fixing apparatus at a storage lower-limit temperature of said image forming apparatus is $R_L$, and a tolerable maximum current value in the fixing apparatus is $I_{max}$, and said applied voltage $V_L$ is set so as to satisfy the following inequalities:

$$V_L < I_{max} \cdot R_L,$$

and $$V_L^2/R_L < W'_{max}.$$

17. An image forming apparatus in an electrophotographic apparatus, comprising:

a fixing apparatus employing a heating roller;

a heat emitting resistor mounted on a surface layer of said heating roller, said heat emitting resistor having a positive temperature characteristic;

wherein, a maximum electric power supplied to said fixing apparatus is $W'_{max}$, a lower-limit temperature employed in said image forming apparatus is $T_0$, a resistance value of said fixing apparatus at temperature $T_0$ of said heating roller is $R_0$, and a standard voltage applied to said fixing apparatus is V, a condition of said fixing apparatus is set so as to satisfy the following inequality:

$$V^2/R_0 \leqq W'_{max}$$

wherein said image forming apparatus further comprises temperature detection means for detecting a temperature at said heating roller, and wherein a voltage greater than the standard voltage is not applied to said heating roller until said temperature at said heating roller detected by said temperature detection means becomes higher than said lower-limit temperature $T_0$.

18. An image forming apparatus as defined in claim 17, wherein the heating roller is a self-heat-emitting heating roller.

19. An image forming apparatus as defined in claim 17, wherein said heating roller is not applied with electricity until the roller surface temperature detected by said temperature detecting means becomes higher than said lower-limit temperature $T_0$.

20. An image forming apparatus as defined in claim 17, wherein said heating roller is applied with a voltage lower than said standard voltage V until the roller surface temperature detected by said temperature detecting means becomes higher than said lower-limit temperature $T_0$.

21. An image forming apparatus as defined in claim 20, wherein, the applied voltage lower than said standard voltage V is $V_L$, a resistance value of said fixing apparatus at a storage lower-limit temperature of said image forming apparatus is $R_L$, and a tolerable maximum current value in the fixing apparatus is $I_{max}$, and said applied voltage $V_L$ is set so as to satisfy the following inequalities:

$$V_L < I_{max} \cdot R_L$$

and $$V_L^2/R_L < W'_{max}.$$

22. An image forming apparatus in an electrophotographic apparatus, comprising:

a fixing apparatus employing a heating roller;

a heat emitting resistor mounted on a surface layer of said heating roller, said heat emitting resistor having a positive temperature characteristic;

wherein, a maximum electric power supplied to said fixing apparatus is $W'_{max}$, a lower-limit temperature employed in said image forming apparatus is $T_0$, a resistance value of said fixing apparatus at the temperature $T_0$ of said heating roller is $R_0$, and a standard voltage applied to said fixing apparatus is V, a condition of said fixing apparatus is set so as to satisfy the following inequality:

$$V^2/R_0 \leqq W'_{max}$$

wherein said image forming apparatus further comprises temperature detection means for detecting a temperature at said heating roller, and wherein, a resistance value at a temperature of said heating roller is R(T), and a voltage greater than said standard voltage is not applied to said heating roller until the temperature of said heating roller detected by said temperature detection means becomes higher than the temperature $T_0$ satisfying the following equation:

$$V^2/R(T) = W'_{max}.$$

23. An image forming apparatus as defined in claim 22, wherein the heating roller is a self-heat-emitting heating roller.

24. An image forming apparatus as defined in claim 22, wherein said heating roller is not applied with electricity until the roller surface temperature detected by said temperature detecting means becomes higher than said lower-limit temperature $T_0$.

25. An image forming apparatus as defined in claim 22, wherein said heating roller is applied with a voltage lower than said standard voltage V until the roller surface temperature detected by said temperature detecting means becomes higher than said lower limit temperature $T_0$.

26. An image forming apparatus as defined in claim 25, wherein, the applied voltage lower than said standard voltage V is $V_L$, a resistance value of said fixing apparatus at a storage lower-limit temperature of said image forming apparatus is $R_L$, and a tolerable maximum current value in the fixing apparatus is $I_{max}$, and said applied voltage $V_L$ is set so as to satisfy the following inequalities:

$$V_L < I_{max} \cdot R_L$$

and $$V_L^2/R_L < W'_{max}.$$

27. An image forming apparatus in an electrophotographic apparatus, comprising a fixing apparatus employing a heating roller;

a heat emitting resistor mounted on a surface layer of said heating roller, said heat emitting resistor having a positive temperature characteristic;

wherein, a maximum electric power supplied to said fixing apparatus is $W'_{max}$, a lower-limit temperature employed in said image forming apparatus is $T_0$, a resistance value of said fixing apparatus at the temperature $T_0$ of said heating roller is $R_0$, and a standard voltage applied to said fixing apparatus is V, a condition of said fixing apparatus is set so as to satisfy the following inequality:

$$V^2/R_0 \leq W'_{max}$$

wherein said image forming apparatus further comprises detection means for detecting a resistance value of said heating roller, and wherein a voltage greater than said standard voltage is not applied to said heating roller until the resistance value of said heating roller becomes higher than the resistance value R satisfying the following equation:

$$V^2/R = W'_{max}.$$

28. An image forming apparatus as defined in claim 27, further comprising temperature detecting means for detecting a temperature of said heating roller surface, and wherein said heating roller is not applied with electricity until the heating roller surface temperature detected by said temperature detecting means becomes higher than said lower-limit temperature $T_0$.

29. An image forming apparatus as defined in claim 27, wherein said heating roller is applied with a voltage lower than said standard voltage V until the roller surface temperature detected by a said temperature detecting means becomes higher than said lower-limit temperature $T_0$.

30. An image forming apparatus as defined in claim 29, wherein, the applied voltage lower than said standard voltage V is $V_L$, a resistance value of said fixing apparatus at a storage lower-limit temperature of said image forming apparatus is $R_L$, and a tolerable maximum current value of the circuit in the fixing apparatus is $I_{max}$, and said applied voltage $V_L$ is set so as to satisfy the following inequalities:

$$V_L < I_{max} \cdot R_L$$

and $$V_L^2/R_L < W'_{max}.$$

* * * * *